US009212878B2

(12) United States Patent
Seeman et al.

(10) Patent No.: US 9,212,878 B2
(45) Date of Patent: Dec. 15, 2015

(54) COMPOSITE PROJECTILE AND CARTRIDGE WITH COMPOSITE PROJECTILE

(71) Applicant: EINSTEIN NOODLES, LLC, Charleston, SC (US)

(72) Inventors: Daniel Jonathan Seeman, Charlotte, NC (US); Dewey Privette, Charlotte, NC (US)

(73) Assignee: Einstein Noodles, LLC, Charleston, SC (US)

( * ) Notice: Subject to any disclaimer, the term of this patent is extended or adjusted under 35 U.S.C. 154(b) by 36 days.

(21) Appl. No.: 14/191,711

(22) Filed: Feb. 27, 2014

(65) Prior Publication Data

US 2015/0276361 A1 Oct. 1, 2015

Related U.S. Application Data

(63) Continuation of application No. 13/772,914, filed on Feb. 21, 2013, now Pat. No. 8,689,696.

(51) Int. Cl.

| | |
|---|---|
| ***F42B 12/74*** | (2006.01) |
| ***F42B 33/00*** | (2006.01) |
| ***F42B 5/02*** | (2006.01) |
| ***F42B 30/02*** | (2006.01) |

(52) U.S. Cl.

CPC ..... *F42B 12/74* (2013.01); *F42B 12/745* (2013.01); *F42B 33/00* (2013.01); *F42B 33/001* (2013.01); *F42B 5/02* (2013.01); *F42B 30/02* (2013.01)

(58) Field of Classification Search

CPC ..... F42B 5/02; F42B 12/72; F42B 12/74; F42B 12/745; F42B 33/00; F42B 33/001; F42B 30/02; C08K 9/08; C08K 3/08; C08L 53/00; C08L 53/02; C08L 55/02

USPC ..... 102/439, 444, 501, 502, 506, 517, 529; 86/54, 55

See application file for complete search history.

(56) References Cited

U.S. PATENT DOCUMENTS

| | | | | |
|---|---|---|---|---|
| 2,835,198 | A | 5/1958 | Brombacher | |
| 5,237,930 | A * | 8/1993 | Belanger et al. | 102/529 |
| 5,786,416 | A * | 7/1998 | Gardner et al. | 524/440 |
| 6,048,379 | A * | 4/2000 | Bray et al. | 75/229 |
| 7,217,389 | B2 * | 5/2007 | Amick | 419/38 |
| 7,353,756 | B2 * | 4/2008 | LeaSure | 102/517 |
| 8,689,696 | B1 | 4/2014 | Seeman et al. | |
| 2003/0101891 | A1 * | 6/2003 | Amick | 102/514 |
| 2015/0075400 | A1 | 3/2015 | Lemke et al. | |

FOREIGN PATENT DOCUMENTS

| | | |
|---|---|---|
| WO | 2014193497 A2 | 12/2014 |
| WO | 2014193497 A3 | 5/2015 |

OTHER PUBLICATIONS

"International Search Report" and "Written Opinion of the International Searching Authority" (ISA/US) in Caneel Associates, Inc., International Patent Application No. PCT/US2014/17516, mailed Mar. 17, 2015 (6 pages).

"Injection Molded Bullets" Guns & Ammo Journal, Jul. 2015 Issue, pp. 69-72, 74, 76, 77, (8 pages).

* cited by examiner

*Primary Examiner* — James S Bergin

(74) *Attorney, Agent, or Firm* — Roeder & Broder LLP; James P. Broder

(57) ABSTRACT

A projectile includes: (a) a cured, toughened polymer resin; and (b) a particulate filler distributed through the resin, the filler having a density greater than a density of the resin, wherein the projectile has average density less than the density of lead.

20 Claims, 1 Drawing Sheet

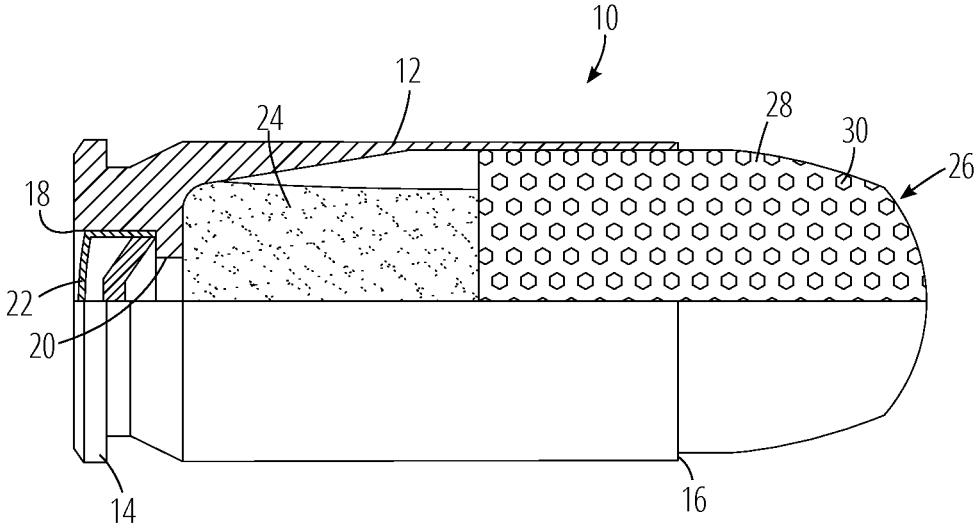
10
12
24
28
30
26
18
22
20
14
16

COMPOSITE PROJECTILE AND CARTRIDGE WITH COMPOSITE PROJECTILE

BACKGROUND OF THE INVENTION

This invention relates generally to projectiles and small arms ammunition, and more particularly to ammunition incorporating composite projectiles.

Conventional small arms ammunition comprises a cartridge having a casing loaded with a propellant powder and a projectile (e.g. a bullet). An impact-sensitive primer ignites the propellant when struck by a gun's firing pin.

Projectiles for such ammunition are most typically made from lead or lead alloys. This material has a high density providing good velocity retention, range, muzzle energy, and target penetration, while being soft enough to engage the rifling in a barrel without damaging the barrel.

Unfortunately, lead is a source of both indoor and outdoor pollution, and is also rising in cost.

Attempts have been made in the prior art to replace lead in projectiles. However, these materials have either been expensive (e.g. tungsten) or have significant performance limitations in terms of structural integrity and target penetration (e.g. polymers).

Furthermore, even when projectiles are made from lead, their expansion characteristics (and related temporary and permanent wounding effects) are limited when incorporated into pistol ammunition, because of the relatively low muzzle energy levels that can be safely generated in a pistol. This limits the so-called "stopping power" of conventional pistol ammunition.

Accordingly, there is a need for a projectile with structural integrity and performance equivalent to a lead projectile, and for a projectile providing enhanced wounding effect compared to lead projectiles.

BRIEF SUMMARY OF THE INVENTION

This need is addressed by the present invention, which provides a projectile having a particulate filler distributed in a polymer matrix, as well as cartridges using these projectiles.

According to one aspect of the invention, a projectile includes: (a) a cured, toughened polymer resin; and (b) a particulate filler distributed through the resin, the filler having a density greater than a density of the resin, wherein the projectile has average density less than the density of lead.

According to another aspect of the invention, a projectile includes: (a) a cured polymer resin; and (b) a particulate filler distributed through the resin, the filler having a density greater than a density of the resin, wherein the projectile is configured to break into fragments substantially larger than powder particles, in response to impact.

According to another aspect of the invention, a method of making a projectile includes: (a) mixing a toughened epoxy resin with a particulate filler, wherein the filler has a density greater than a density of the resin, and mixing the toughened epoxy resin with a curative agent; (b) introducing the mixture into a projectile mold having a cavity in a desired projectile shape; (c) allowing the resin to cure so as to form a completed projectile; and (d) removing the projectile from the mold, wherein the completed projectile has an average density less than the density of lead.

BRIEF DESCRIPTION OF THE DRAWINGS

The invention may be best understood by reference to the following description taken in conjunction with the accompanying single drawing FIGURE which is a partially-sectioned side view of a cartridge constructed in accordance with an aspect of the present invention.

DETAILED DESCRIPTION OF THE INVENTION

Referring to the drawing, the single FIGURE illustrates an exemplary cartridge 10 constructed according to the present invention. The cartridge 10 includes a generally cylindrical casing 12 with a base 14 at one end and a mouth 16 at the opposite end.

For the purposes of illustration the example cartridge is a 11.4 mm (45 in.) caliber Automatic Colt Pistol cartridge (commonly identified as "0.45 ACP"). However, it will be understood that the principles of the present invention may be extended to any type or caliber of cartridge.

The base 14 includes a primer pocket 18 with a flash hole 20 communicating with the interior of the casing 12. A conventional primer 22 is disposed in the primer pocket 18. A powder charge 24 of propellant (such as conventional smokeless gunpowder) is disposed in the interior of the casing 12, in communication with the flash hole 20.

The casing 12 is of conventional construction, for example it may be drawn from brass or aluminum alloys or molded from plastic. Any commercially-available casing is suitable for this purpose. It is also known to create "caseless" ammunition rounds wherein a propellant charge is loaded into a projectile having an extended base forming a powder enclosure, or wherein propellant is mixed with a suitable binder and molded into the shape of a cartridge case. In this type of ammunition the projectile is fixed in position relative to the propellant. In addition to breech-loading firearms, the principles of the present invention are applicable to such caseless ammunition, as well as to muzzle-loading firearms using either separate powder and ball or combustible (e.g. paper) cases.

A projectile 26 is retained in the mouth 16 of the casing. The projectile 26 comprises a non-metallic matrix 28 with a particulate filler 30 distributed therethrough. Optionally, the projectile 26 may be lead-free. As used herein, the term "lead-free" refers to a projectile which does not have lead intentionally included in its composition and which includes lead only to the degree that it is an unavoidable impurity in other components of the composition.

More specifically, the matrix 28 is a toughened polymeric resin. As used herein, the term "toughness" generally refers to the ability to absorb energy and plastically deform before fracturing, or in other words the opposite of "brittle." The toughness or brittleness of a particular material is a matter of degree. In industry usage, a "toughened resin" typically refers to a polymer containing an elastomeric component which imparts toughness. As used herein, "toughened" describes the cured state of the resin, and it is noted that the chemical component providing the quality of toughness may be provided by any of the constituent components used to produce the final resin, or may come about as a result of the curing reaction. One non-limiting example of a suitable toughened epoxy resin is an elastomer-modified epoxy functional adduct formed by the reaction of a bisphenol A liquid epoxy resin and a carboxyl terminated butadiene-acrylonitrile elastomer. The elastomer content is 40% by weight. This material is commercially available.

The filler 30 may be any powder or particulate. Non-limiting examples include lead, depleted uranium, copper, tungsten, bismuth, ceramic, bronze, iron and steel, clay, mica, silica, calcium carbide, and micro-encapsulated materials (wherein a selected material is encapsulated in a particulate-sized shell. Preferably the filler 30 is of higher density than the cured matrix 28.

This combination of materials has been found to have important advantages over conventional metal alloy projectiles. In particular, projectiles made from this combination of materials can have significantly improved wounding performance than conventional homogenous metallic projectiles, and may have less mass than conventional projectiles. Depending on material selection, the projectiles 26 may be less toxic than conventional lead projectiles.

EXAMPLE 1

Projectiles 26 have nominal dimensions conforming to the 0.45 ACP standard were produced using varying amounts of the toughened epoxy resin described above as the matrix 28 and iron powder (U.S. Standard Mesh size 108) as the filler 30, using the following process. First, the epoxy resin was heated to an appropriate temperature, about 49° C. (120° F.) to reduce its viscosity and permit mixing and distribution of the filler 30. The proper temperature is dependent on particle size. The finer the powder, the lower the viscosity needs to be for proper mixing. Next, the filler 30 was mixed into the resin. After mixing, a conventional hardener (an amine) was added to the resin/filler mixture, at a ratio of 10 parts resin to 1 part hardener. As used herein, the term "hardener" refers to any type of curative agent for the resin. The mixture was then poured into a prepared projectile mold. The resin/filler/hardener mixture was cured to produce an epoxy polymer, and the projectile 26 was removed from the mold.

The finished projectiles 26 were found to have the filler 30 distributed through the resin. The mass of the projectiles varied depending on the type and amount of filler used, as well as the total length of the projectile. It is noted that the mass of the projectile 26 can be varied from a baseline by changing either its density or its volume. This is limited by a need to maintain a certain minimum length to ensure that the projectile 26 does not jam in a barrel and will not tumble during flight. Projectiles were produced with a range of masses from less than 2.6 g (40 grains) to over 5.8 g (90 grains). By comparison, a conventional lead projectile with the same exterior dimensions would typically have a mass of about 14.9 g (230 grains). Accordingly, the average density of the projectiles 26 was less than 45% of the density of a lead projectile of equal exterior dimensions.

For the example caliber tested, and for the specific combination of resin, hardener, and filler used with the example caliber, a range of 20% to 30% by weight of resin was preferred. The preferred proportion of resin will vary with various factors such as the type of resin and hardener, the type and size of filler, and so forth. In one particular tested example, the composition of the projectile 26 was 26% by weight resin and 74% by weight filler. It is believed that the composition and manufacturing method described above results in the epoxy bonding to the iron particle filler creating a homogeneous and cohesive matrix which allows it to withstand the forces created during firing of the projectile 26. The properties of this projectile 26 are such that, in response to an impact of enough force to fracture the projectile 26, the projectile 26 will break up into large fragments having significant mass that are substantially larger than powder particles, instead of breaking up into powder or dust, which is common with known prior art projectiles of composite construction. As an example, the fragments may have a minimum size on the order of about 2.5 mm (0.10 in.), or about 20 times the size of powder particles.

EXAMPLE 2

The projectiles 26 described above can be incorporated into cartridges 10 having powder loads much greater than conventionally used. In combination with a lower-mass projectile, this generates needed muzzle velocity and energy to have lethality (i.e. temporary and permanent wounding characteristics) similar to a conventional lead projectile, when used as offensive or defensive ammunition.

For example, projectiles 26 described above in 0.45 ACP caliber, having a weight of about 5.8 g (90 grains), were loaded into cartridges 10 with a powder load sufficient to generate a muzzle velocity of about 701 m/s (2300 ft/s) to 732 m/s (2400 ft/s) when fired from a 12.7 cm (5 in.) long barrel.

The cartridges 10 were found to exhibit unexpected performance characteristics. The projectiles 26 had excellent structural integrity and did not fail or break up in flight even at the extremely high muzzle velocities. This is believed to be a result of a synergistic interaction between the polymer resin and the particulate filler.

The projectiles 26 were fired into water-soaked paper telephone books at a range of about 13.7 m (15 yd). The projectiles 26 exhibited excellent target penetration, approximately 15.2 cm (6 in.) depth. The projectiles 26 also showed a "shotgun blast" effect. In particular, a projectile 26 of nominal 0.45 ACP diameter, approximately 11.46 mm (451 in.) was found to produce an entry hole in a target of about 5.1 cm (2 in.) diameter, and an exit hole much greater than 5.1 cm (2 in.) diameter. In thin, tough targets such as steel drum heads, the same projectile 26 was found to produce a through-hole of about 5.1 cm (2 in.) diameter. This is a larger hole than would be expected even with a conventional hollow-point or soft lead "dum-dum" projectiles. Observation after firing indicates that the projectile 26 remained intact in flight to the target. It is believed that the projectiles 26 may expand to a large diameter upon initial contact, creating the large-diameter holes mentioned above. Recovered projectiles were found to be in fragments of a size significantly larger than powder. The projectiles 26 may have broken up into fragments upon initial contact with the target, or may have broken up after substantial intact expansion. The "shotgun blast" effect and large hole size was observed regardless of exactly when or how the projectile expanded and/or fragmented.

It is noted that the principles of the present invention are applicable to composite projectiles having other compositions that also display the penetration and expansion/fragmentation properties described above. For example other polymer resins, not necessarily classified as "toughened", may be found that interact with a filler to produce the projectile properties described herein.

This type of expansion and/or fragmentation stands in stark contrast to prior art composite projectiles, which are typically configured to disintegrate into powder-sized particles. This performance was observed when the muzzle energy was about 1.22 kJ (900 ft-lb) or greater. The mass of the projectile 26 and the power charge may be varied to achieve this energy level. The perceived recoil of these cartridges 10 was no greater than reference cartridges of the same caliber loaded with conventional jacketed lead projectiles to standard velocities.

Furthermore, the cartridges 10 did not exhibit signs of overpressure, such as case cracking or raised primers, and are therefore suitable for use in conventional firearms.

These projectiles and ammunition rounds are believed to be especially lethal and suitable for hunting, military, or self-defense purposes while maintaining recoil at levels equal to or less than conventional lead projectile rounds. The performance of these rounds allows a handgun to provide the lethality that is typically associated with rifle ammunition.

The loads may be varied to suit a particular end use. For example, if the projectile mass is reduced to about 2.6 g (40 grains), no penetration of a target is observed. At about 3.9 g (60 grains), some penetration is observed. At 5.2 g to 5.8 g (80 grains to 90 grains), excellent penetration is observed as described above. Projectiles of lower masses may be desirable as target rounds or non-lethal rounds.

The foregoing has described composite projectiles and ammunition made from composite projectiles. While specific embodiments of the present invention have been described, it will be apparent to those skilled in the art that various modifications thereto can be made without departing from the spirit and scope of the invention.

What is claimed is:

1. A method of making a projectile for an ammunition cartridge, comprising the steps of:

(a) mixing together to form a mixture, (i) an elastomer-modified epoxy functional adduct formed by the reaction of a bisphenol A liquid epoxy resin and a carboxyl terminated butadiene-acrylonitrile elastomer, (ii) a filler, and (iii) a curative agent, (iv) wherein the filler is distributed throughout the mixture;

(b) introducing the mixture into a projectile mold having a cavity in a shape of a bullet;

(c) allowing the elastomer-modified epoxy functional adduct of the mixture to cure so as to form a completed projectile; and (d) removing the projectile from the mold.

2. The method of claim 1, wherein the filler has a density greater than a density of the elastomer-modified epoxy functional adduct.

3. The method of claim 1, wherein the completed projectile has an average density less than the density of lead.

4. The method of claim 1, wherein step (a) comprises heating the elastomer-modified epoxy functional adduct to reduce its viscosity and, thereafter, mixing in the filler.

5. The method of claim 1, wherein step (a) comprises heating the elastomer-modified epoxy functional adduct to reduce its viscosity; thereafter, mixing in the filler; and thereafter, adding the curative agent.

6. The method of claim 1, wherein the filler comprises a particulate filler.

7. The method of claim 6, wherein the filler comprises a powder.

8. The method of claim 1, wherein the filler comprises tungsten.

9. The method of claim 1, wherein the filler comprises lead.

10. The method of claim 1, wherein the elastomer content is 40 percent by weight of the elastomer-modified epoxy functional adduct.

11. A method of making an ammunition cartridge, comprising the steps of:

(a) mixing together to form a mixture, (i) an elastomer-modified epoxy functional adduct formed by the reaction of a bisphenol A liquid epoxy resin and a carboxyl terminated butadiene-acrylonitrile elastomer, (ii) a filler, and (iii) a curative agent (iv) wherein the filler is distributed throughout the mixture;

(b) introducing the mixture into a projectile mold;

(c) allowing the elastomer-modified epoxy functional adduct of the mixture to cure so as to form a completed projectile; and (d) removing the completed projectile from the mold and assembling the projectile with a primer and propellant within a casing for an ammunition cartridge.

12. The method of claim 11, wherein the ammunition cartridge is a cartridge for a pistol.

13. The method of claim 12, wherein the ammunition cartridge is a cartridge for a .45 inch caliber pistol.

14. The method of claim 11, wherein the filler has a density greater than a density of the elastomer-modified epoxy functional adduct.

15. The method of claim 11, wherein the completed projectile has an average density less than the density of lead.

16. A method of making an ammunition cartridge, comprising the steps of:

(a) providing a completed projectile, comprising:

(1) a toughened polymer resin comprising an elastomer-modified epoxy functional adduct formed by the reaction of a bisphenol A liquid epoxy resin and a carboxyl terminated butadiene-acrylonitrile elastomer;

(2) a filler distributed throughout the toughened polymer resin, the filler having a density greater than a density of the toughened polymer resin; and (3) a curative agent by which the toughened polymer resin with distributed filler is cured; and (b) assembling the completed projectile with a primer and propellant within a casing for an ammunition cartridge.

17. The method of claim 16, wherein the ammunition cartridge is a cartridge for a pistol.

18. The method of claim 17, wherein the ammunition cartridge is a cartridge for a .45 inch caliber pistol.

19. The method of claim 16, wherein the filler comprises a particulate filler.

20. The method of claim 16, wherein the completed projectile has an average density less than the density of lead.

* * * * *